US007694376B2

(12) United States Patent
Wang et al.

(10) Patent No.: US 7,694,376 B2
(45) Date of Patent: Apr. 13, 2010

(54) CLEANSING MODULE FOR FLUID-SUPPLY APPARATUS

(75) Inventors: Jiun-Ming Wang, Changhua County (TW); Yu-Cheng Lo, Taipei (TW); Ching-Chun Chien, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1050 days.

(21) Appl. No.: 11/162,412

(22) Filed: Sep. 9, 2005

(65) Prior Publication Data

US 2007/0056604 A1 Mar. 15, 2007

(51) Int. Cl.
*B08B 9/38* (2006.01)
*B08B 1/02* (2006.01)

(52) U.S. Cl. ..... 15/104.05; 15/93.1; 15/104.16; 134/184; 347/27; 347/28; 347/32

(58) Field of Classification Search ..... 134/184; 15/3, 21.1, 93.1, 104.16, 104.05, 220.02; 347/22, 27, 28
See application file for complete search history.

(56) References Cited

U.S. PATENT DOCUMENTS 2,657,668 A * 11/1953 Maier ..... 118/612
3,839,085 A * 10/1974 Hulvey et al. ..... 134/8
4,194,922 A * 3/1980 Gransell et al. ..... 134/1
4,279,754 A * 7/1981 Pollock ..... 210/608
5,574,485 A * 11/1996 Anderson et al. ..... 347/27
5,653,816 A * 8/1997 Ekberg ..... 134/1
5,813,074 A * 9/1998 Liljeholm ..... 15/21.1
6,471,328 B1 * 10/2002 Becker et al. ..... 347/28
2002/0060724 A1 5/2002 Le et al. ..... 347/71
2002/0080209 A1 6/2002 Lin ..... 347/33
2002/0181828 A1 12/2002 Irwin et al. ..... 347/34

FOREIGN PATENT DOCUMENTS

JP 08-118668 5/1996
TW 581732 4/2004

* cited by examiner

*Primary Examiner*—Michael Barr
*Assistant Examiner*—Saeed T Chaudhry
(74) *Attorney, Agent, or Firm*—Jianq Chyun IP Office

(57) ABSTRACT

A cleansing method of fluid-supply apparatus and cleansing module using the same is disclosed. First, a cleansing module is fixed to the fluid-supply apparatus to be cleansed for disposing the nozzles of the fluid-supply apparatus in the cleansing tank of the cleansing module. Second, a liquid used for cleansing is supplied inside the cleansing tank, and ultrasonic-wave vibration of the liquid is provided to remove plug stuck on the nozzles. Later, plug remained on the nozzles is scraped down and meanwhile the waste liquid is drawn out of the cleansing tank for further improving cleansing efficiency of the cleansing method. By using the cleansing method of the present invention, plug on the nozzles of the fluid-supply apparatus can be effectively removed and consequently lifetime of the fluid-supply apparatus is extended. Additionally, the cleansing method is capable of dramatically reducing working time required and of increasing efficiency of cleansing fabrication process.

12 Claims, 4 Drawing Sheets

CLEANSING MODULE FOR FLUID-SUPPLY APPARATUS

BACKGROUND OF THE INVENTION

1. Field of Invention

The present invention relates to a cleansing method and a cleansing apparatus. More particularly, the present invention relates to a cleansing method of a fluid-supply apparatus and a cleansing module for the same.

2. Description of Related Art

In the semi-conductor and display industries nowadays, the ink-jet fabricating process is widely used to form coating layers with patterns. The coating layers such as color-layers on the color filter (CF), the polymer organic light-emitting layers and polymer-protection layers (PI) in the organic electro-luminescence display (OELD) and so forth, can be formed by utilizing the ink-jet fabricating process.

Since nozzles of the ink-jet head presently used in the ink-jet fabrication process have openings with diameters approximately 20 mm to 90 mm wide, the existence of impurities and large-scale suspending species contained in the ink would cause the blocking of nozzles of the ink-jet head. Therefore, lifetime of the ink-jet head is reduced. Also, when nozzles are plugged by some strange species or bubbles, ink droplets cannot be ejected effectively, resulting in non-uniform thicknesses of coating layers formed in the ink-jet fabrication process and decreasing yield of production.

One way to solve the previously-mentioned problems in the prior art is to apply a driving voltage on ink-jet head to perform multiple ink-ejecting trials. However, it is quite wasteful in ink and accompanied with increased cost. Alternative is to enhance instantaneous ejecting-force for ink by varying driving-wave pattern of the ink-jet head, but the effect is limited and plugging of nozzles can't be completely resolved. Besides, there are still methods, for example, by cleansing the strange species on the nozzles by wiping with dusty-free wipers, or by providing a high-temperature ink-ejecting. Nevertheless, dusty-free wipers used to wipe the nozzles would cause the nozzles to be plugged by fibers of the dusty-free wiper, and the high-temperature ink-ejecting is not suitable for every sort of ink and plenty of working hours are required for raising and lowering the temperature.

SUMMARY OF THE INVENTION

In view of this, one object of the present invention is to provide a cleansing module capable of effectively cleansing nozzles for any kind of fluid-supply apparatus and of increasing lifetime of the fluid-supply apparatuses.

Another object of the present invention is to provide a cleansing method of a fluid-supply apparatus, capable of effectively cleansing nozzles of any kind of fluid-supply apparatus and of decreasing the cleansing time required.

The present invention provides a cleansing module for cleansing nozzles of a fluid-supply apparatus. The cleansing module comprises a base, an ultrasonic-wave generator and a scraper. Wherein, the base has a cleansing tank and the ultrasonic-wave generator and the scraper are both disposed in the cleansing tank. The scraper is suitable for moving on the bottom of the cleansing tank.

In one preferred embodiment of the present invention, the cleansing module further comprises a mounting piece which is disposed on the base for fixing the cleansing module to the fluid-supply apparatus. In one embodiment, the mounting piece is a clamping piece for example.

In one preferred embodiment of the present invention, the cleansing module mentioned above, for example, further comprises a scraper kit for bearing the scraper. Wherein, a material of the scraper can be silicon and a material of the scraper kit can be a magnetic material. Additionally, the cleansing module mentioned above can further comprises a magnet that is movable and disposed below the base for controlling the movement of the scraper on the bottom of the cleansing tank. In one embodiment, the bottom of the base has a sliding tracks on which the magnet is disposed, and the magnet moves along the sliding tracks, for example.

In one preferred embodiment of the present invention, the bottom of the cleansing tank mentioned above has a plurality of air-drawing vents and the cleansing module mentioned above further comprises a gas pump to which the air-drawing vents are connected, for example.

In one preferred embodiment of the present invention, when the base is fixed to the fluid-supply apparatus to be cleansed, the nozzles of the fluid-supply apparatus are oriented somewhere except the air-drawing vents on the bottom of the cleansing tank.

The present invention provides a cleansing module for cleansing nozzles of a fluid-supply apparatus. The cleansing module comprises a base, a scraper, a scraper kit and a magnet. Wherein, the base has a cleansing tank in which the scraper is disposed tank suitable for moving on the bottom of the cleansing tank. The scraper kit is used for bearing the scraper of a magnetic material. The magnet is movable and disposed below the base for controlling the movement of the scraper on the bottom of the cleansing tank.

In one preferred embodiment of the present invention, the bottom of the base mentioned above for example has a sliding tracks on which the magnet is disposed and the magnet moves along the sliding tracks.

In one preferred embodiment of the present invention, the bottom of the cleansing tank mentioned above has a plurality of air-drawing vents, and the cleansing module mentioned above further comprises a gas pump to which the air-drawing vents are connected for example.

The present invention also provides a cleansing method of a fluid-supply apparatus used for cleansing the nozzles of the fluid-supply apparatus. The method sequentially comprises: fixing a cleansing module which has a cleansing tank to the fluid-supply apparatus wherein the nozzles of the fluid-supply apparatus are disposed in this cleansing tank; supplying a liquid inside the cleansing tank; providing ultrasonic-wave inside the cleansing tank to cause the ultrasonic vibration; scraping off plug stuck on the nozzles; and separating the cleansing module from the fluid-supply apparatus.

In one preferred embodiment of the present invention, for the method of supplying a liquid inside the cleansing tank, for example, the liquid is supplied by the fluid-supply apparatus mentioned above.

In one preferred embodiment of the present invention, frequencies of ultrasonic-wave used in the cleansing method above range between 20 kHz and 80 kHz.

In one preferred embodiment of the present invention, at the moment that the plug stuck on the nozzles are scraped off in the cleansing method mentioned above, drawing of the liquid out of the cleansing tank is further comprised, for example.

The cleansing module of the present invention is capable of effectively eliminating the plug stuck on the nozzles of the fluid-supply apparatus, and thereby extending lifetime of the fluid-supply apparatus. Besides, by using the cleansing method of the present invention, working hours required can be dramatically reduced and efficiency of the cleansing fabricating process can be increased.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
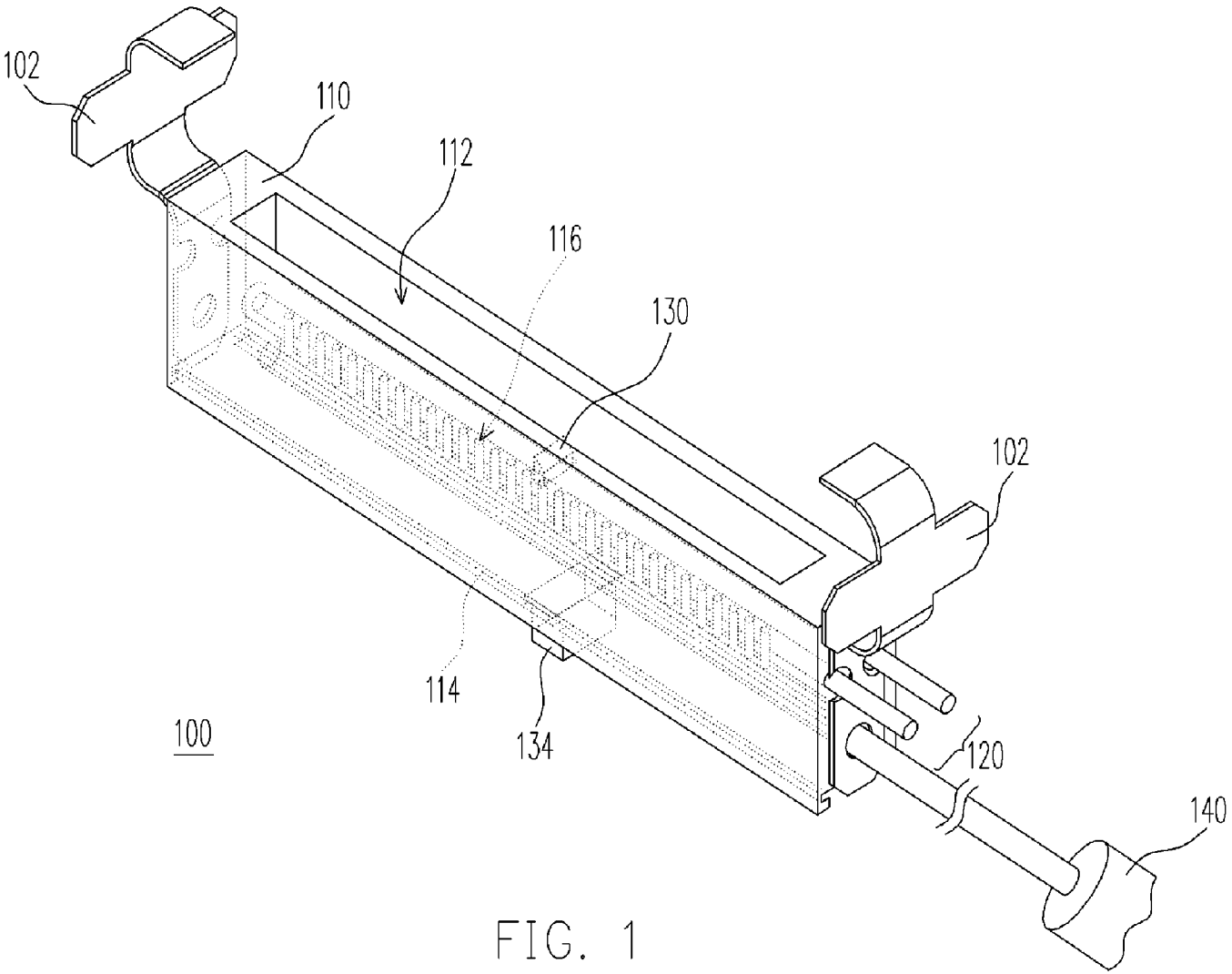
FIG. 1 is a three-dimensional perspective diagram, schematically showing a cleansing module according to one preferred embodiment of the present invention.
Figure 2:
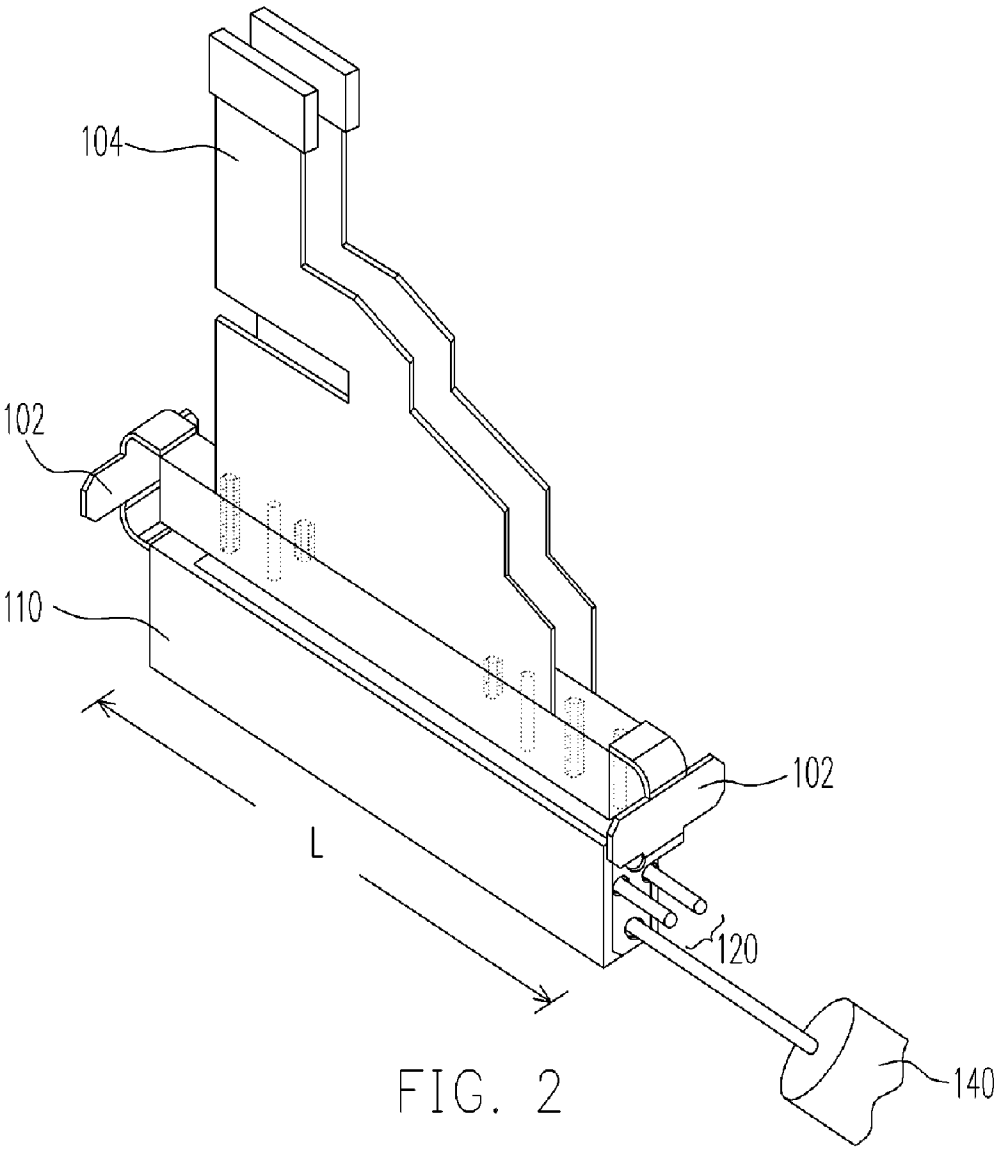
FIG. 2 is a three-dimensional diagram, schematically showing the placement of the fluid-supply apparatus to be cleansed on the cleansing module in FIG. 1.

FIG. 1 is a three-dimensional perspective diagram schematically showing a cleansing module according to one preferred embodiment of the present invention, and FIG. 2 is a perspective diagram schematically showing the fluid supply apparatus to be cleansed mounted on the cleansing module in FIG. 1. Please refer to FIG. 1. The cleansing module 100 is used for cleansing the nozzles of the fluid-supply apparatus (not shown). The nozzles of the ink-jet heads, for example, used to form color areas of color filters, the polymer organic light-emitting layers of the organic electro-luminescence display (OELD) or the polymer-protection layers, can be cleansed by utilizing the cleansing module 100 of the present invention.

Referring to FIG. 1 and FIG. 2, the cleansing module 100, for example, comprises a base 110, an ultrasonic-wave generator 120, and a scraper 130. Wherein, the base 110 is a strip with length L about 100 mm. Also, the base 110 has a cleansing tank 112 for placing the nozzles (not shown) of the fluid-supply apparatus 104 to be cleansed, as shown in FIG. 2. In the present embodiment, a mounting piece 102, for example a clamping piece, is mounted on either ends of the base 110 to enable the fluid supply apparatus to be cleansed 104 and the base 110 to be clamped together. Therefore, the fluid supply apparatus to be cleansed 104 can be fixed on the base 110 during the cleansing process, as shown in FIG. 2. There are still other methods, and not limited by the present invention, to fix the fluid-supply apparatus to be cleansed 104 on the base 110.

Figure 3:
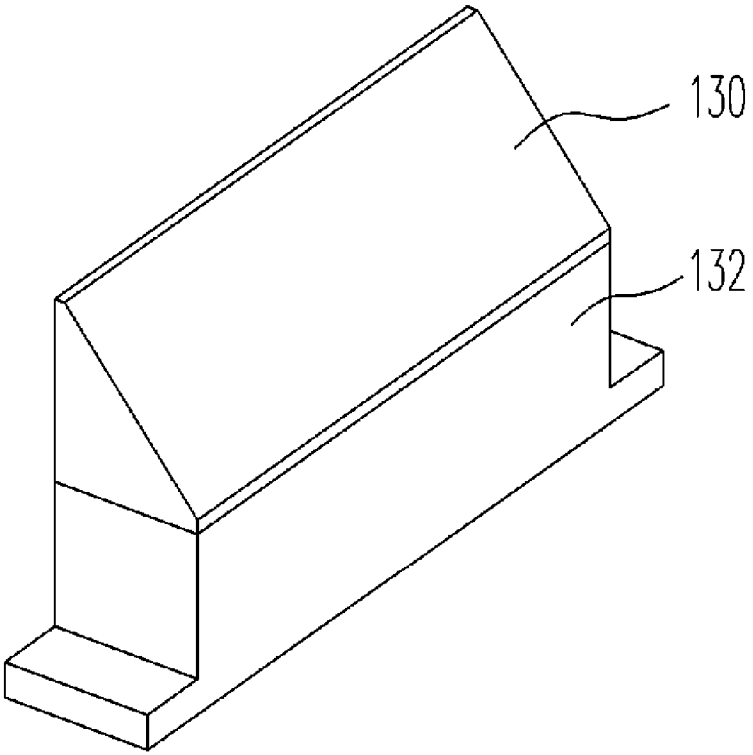
FIG. 3 is an enlarged diagram, schematically showing the scraper and the scraper kit in FIG. 1.

Referring to FIG. 1, the scraper 130 is removable and disposed on the bottom of the cleansing tank 112 for scraping off the plug stuck on the nozzles (not shown) to be cleansed. It is worthy to note that the movement of the scraper 130 on the bottom of the cleansing tank 112 in the present invention, for example, is controlled by the field force. For example, the cleansing module 100 may comprise a scraper kit 132 (as shown in FIG. 3) for bearing the scraper 130 wherein the scraper kit 132 is made of a magnetic material, and a magnet 134 is disposed below the base 110. Here, the magnet 134 is disposed on the sliding tracks 114 of the bottom of the base 110 for instance and also moves along the sliding tracks 114. Thus, due to the magnetic force between the scraper kit 132 and the magnet 134, the scraper kit 132 made of a magnetic material moves with the magnet 134. And it follows that the scraper 130 moves on the bottom of the cleansing tank 112 with the magnet 134.

In addition, the material of the scraper 130 is a soft material to prevent wearing of nozzles during the cleansing process. In one preferred embodiment, the material of the scraper 130 may be silicon, for example.

Referring to FIG. 1 again, the ultrasonic-wave generator 120 is disposed inside the cleansing tank 112 and composed of two set of wires disposed on either sides of the cleansing tank 112 respectively. In one embodiment, the ultrasonic-wave generator 120, for example, is used to produce ultrasonic-wave with frequencies from 20 kHz to 80 kHz inside the cleansing tank 112 for generating the ultrasonic-wave vibration and eliminating plug on the nozzles to be cleansed accordingly.

It is worthy to note that, in one preferred embodiment the cleansing module 100 further comprises a gas pump 140, and the bottom of the cleansing tank of the base 110 has a plurality of air-drawing vents, with diameters 1 mm for example. The gas pump 140 is connected to these air-drawing vents 116 for drawing off the waste liquid produced inside the cleansing tank 112 during the cleansing process. Note that when the base 110 of the cleansing module 100 is fixed to the fluid-supply apparatus to be cleansed, the nozzles of the fluid-supply apparatus 104 are oriented towards somewhere except those air-drawing vents 116. That is, nozzles to be cleaned do not face the air-drawing vents 116 for preventing the fluid-supply apparatus from being damaged during the air-drawing process.

To familiarize those who skilled in the prior art with further understanding of the cleansing method of the fluid-supply apparatus using the cleansing module of the present invention, exemplary examples are taken below.

Figure 4:
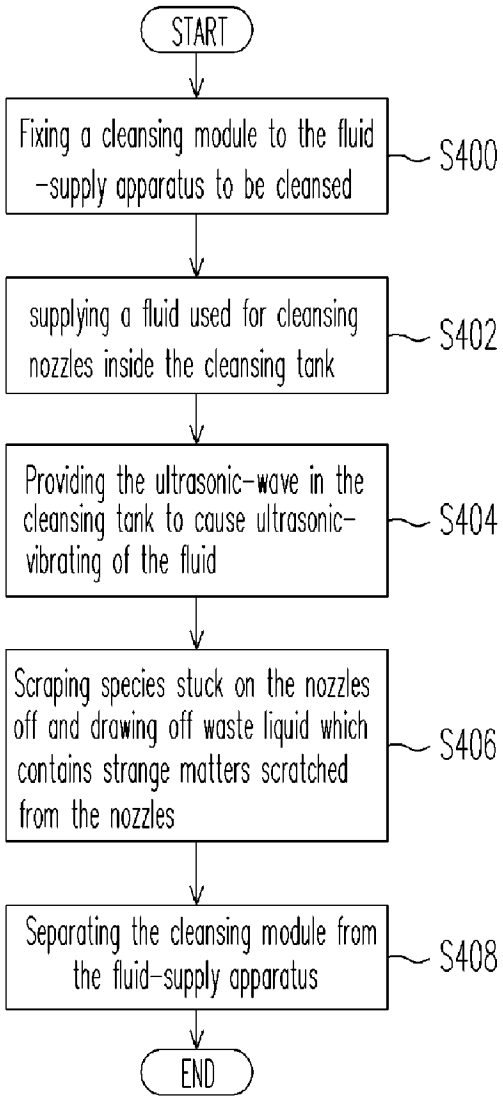
FIG. 4 is a flowchart, schematically illustrating the cleansing steps of the fluid-supply apparatus according to one preferred embodiment of the present invention.

FIG. 4 is a flowchart schematically illustrating the cleansing steps of the fluid-supply apparatus according to one preferred embodiment of the present invention. Please refer to FIGS. 1, 2 and 4 simultaneously. First, the step S400 of fixing the fluid-supply apparatus 104 that is to be cleansed to the cleansing module 100 is performed. Here, a mounting piece 120, for example, is used to fix the fluid-supply apparatus 104 to the base 110 of the cleansing module 100. The nozzles of the fluid-supply apparatus 104 are disposed in the cleansing tank 112. Later, the step S402 is performed for providing the liquid used to cleanse nozzles inside the cleansing tank 112. In one embodiment, a method of providing the liquid is to provide the liquid by the fluid-supply apparatus 104. For example, provided that the ink-jet head is the fluid-supply apparatus 104 in the ink-jet fabricating process, in the step S402, this ink-jet head is triggered to eject the ink lasting for about 5 seconds.

It is well-known that in the prior art, except the liquid mentioned above, i.e., the ink supplied by the fluid-supply apparatus 104 itself, the liquids used for cleansing nozzles can be, but not limited by the present invention, ionized waters or organic solvents.

Referring to FIGS. 1, 2 and 4 continuously, the step S404 to be performed next is to generate ultrasonic-wave vibration inside the cleansing tank 112 to execute ultrasonic-wave vibration of liquid so that the plug stuck on nozzles of the fluid-supply apparatus 104 gets dropped into the liquid in the cleansing tank 112. The step S404 here, for example, the ultrasonic-wave is provided by the ultrasonic-wave generator 120 shown in FIGS. 1 and 2. And the ultrasonic-wave generator 120 may be activated continuously for about 60 seconds to generate ultrasonic-wave with frequencies ranging between 20 kHz to 80 kHz.

Later, the step S406 to scrape off remaining plug stuck on the nozzles is performed. For instance, the step S406 is to scrape off the plug stuck on the nozzles by using the scraper 130 in FIG. 1. Further, in one preferred embodiment, when the plug stuck on the nozzles is scraped off, meanwhile, it is ensured that no strange species get stuck on the nozzles again by using the gas pump 140 in FIG. 1 drawing off the waste liquid containing strange species scraped down from the nozzles in the cleansing tank 112. Wherein, the operation time of step S406, including scraping off stuck species and drawing off the liquid, requires about 10 seconds.

At last, the fluid-supply apparatus 104 is separated from the base 110, as described in step S408. The cleansing of nozzles of the fluid-supply apparatus 104 is thus completed.

To sum up, the cleansing module of the present invention is to eliminate the plug on nozzles of the fluid-supply apparatus by providing the ultrasonic-wave vibration, and then the plug remained on the nozzles is further scraped off by the scraper. At the moment, the waste liquid produced during the cleansing process is drawn out of the cleansing tank by using the gas pump. Therefore, the cleansing module of the present invention can effectively eliminate the plug on nozzles of the fluid-supply apparatus and thereby extend lifetime of the fluid-supply apparatus.

In addition, compared with the working time required for the prior art to cleanse the fluid-supply apparatus demanding 10 to 15 minutes, only about 80 to 120 seconds is required to cleanse the fluid-supply apparatus by utilizing the cleansing method of the present invention. It is obviously that the present invention, compared to the prior art, can dramatically reduce working time required and increase efficiency of the cleansing fabrication process accordingly.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A cleansing module suitable for cleansing a plurality of nozzles of a fluid-supply apparatus, comprising:
- a base having a cleansing tank;
- an ultrasonic-wave generator disposed in the cleansing tank; and
- a scraper disposed in the cleansing tank suitable for moving along a bottom of the cleansing tank by a magnetic field force, wherein the scraper has an open end and a restricted end opposite to the open end, the restricted end is restricted by the magnetic field force and the open end is directed away from the bottom of the cleansing tank so that the open end contacts the nozzles when the fluid-supply apparatus is fixed on the base.

2. The cleansing module according to claim 1, further comprising a mounting piece which is disposed on the base suitable for fixing the cleansing module to the fluid-supply apparatus.

3. The cleansing module according to claim 2, wherein the mounting piece includes a clamping piece.

4. The cleansing module according to claim 1, further comprising a scraper kit suitable for bearing the scraper and a material of the scraper kit is a magnetic material.

5. The cleansing module according to claim 4, further comprising a magnet movable and disposed below the base for controlling the movement of the scraper on the bottom of the cleansing tank.

6. The cleansing module according to claim 5, the base further comprises a sliding tracks disposed on the bottom of the base and the magnet is disposed on the sliding tracks and moves along the sliding tracks.

7. The cleansing module according to claim 1, wherein a material of the scraper includes silicon.

8. The cleansing module according to claim 1, wherein the bottom of the cleansing tank has a plurality of air-drawing vents and the cleansing module further comprises a gas pump to which the air-drawing vents are connected.

9. The cleansing module according to claim 8, wherein when the base is fixed to the fluid-supply apparatus, the nozzles of the fluid-supply apparatus are oriented somewhere except the air-drawing vents on the bottom of the cleansing tank.

10. A cleansing module for suitable for cleansing a plurality of nozzles of a fluid-supply apparatus, comprising:
- a base having a cleansing tank;
- a scraper disposed in the cleansing tank and the scraper being suitable for moving along a bottom of the cleansing tank, wherein the scraper has an open end and a restricted end opposite to the open end, and the open end is directed away from the bottom of the cleansing tank so that the open end contacts the nozzles when the fluid-supply apparatus is fixed on the base;
- a scraper kit suitable for bearing the scraper, the restricted end being restricted by the scraper kit and a material of the scraper kit being a magnetic material; and
- a magnet movable and disposed below the base for controlling the movement of the scraper on the bottom of the cleansing tank.

11. The cleansing module according to claim 10, wherein the bottom of the cleansing tank has a plurality of air-drawing vents and the cleansing module further comprises a gas pump to which the air-drawing vents are connected.

12. The cleansing module according to claim 10, the base further comprises a sliding tracks disposed on the bottom of the base and the magnet is disposed on the sliding tracks and moves along the sliding tracks.

* * * * *